US005727656A

United States Patent [19]

Gaudioso et al.

[11] Patent Number: 5,727,656

[45] Date of Patent: Mar. 17, 1998

[54] VEHICLE LIFT APPARATUS

[76] Inventors: Jennaro A. Gaudioso, 228 Hopewell-Princeton Rd., Hopewell, N.J. 08525; Gene L. Michaels, 904 S. Belnord Ave., Baltimore, Md. 21224

[21] Appl. No.: 650,801

[22] Filed: May 20, 1996

[51] Int. Cl.[6] ..... B66F 7/28

[52] U.S. Cl. ..... 187/221; 254/89 R

[58] Field of Search ..... 187/203, 216, 187/218, 210, 220, 221; 254/89 R, 89 H

[56] References Cited

U.S. PATENT DOCUMENTS

| | | | |
|---|---|---|---|
| 3,713,515 | 1/1973 | Hott | 187/221 |
| 5,211,264 | 5/1993 | Beattie et al. | 187/221 |

*Primary Examiner*—Kenneth Noland

[57] ABSTRACT

The present invention comprises a small vehicle lift having two vertical columns securely mounted to the floor. A first vertical column includes a motor for operating a set of pulleys housed within both first and second vertical columns. The pulleys and cables manipulate a first and second mounting bracket housed within interior tracks of the first and second vertical columns. The mounting brackets are manipulated in a vertical direction within the interior tracks. Linear arms are pivotally secured to the mounting brackets. The linear arms comprise a first member housing a telescoping second member therein. The configuration of the first and second members are such as to accommodate the weight of a wheeled vehicle thereon. On a distal end, opposite from the mounting bracket, is mounted a trough. The trough is pivotally connected to the second member and is of sufficient width to accommodate the tire width of a wheeled vehicle. The trough includes raised borders defining the side wall perimeter of the trough. In addition, the trough includes a stop positioned at a distal end of the trough. On the opposite distal end is mounted a removable ramp held to the trough by a removable locking pin.

20 Claims, 3 Drawing Sheets

VEHICLE LIFT APPARATUS

BACKGROUND OF THE INVENTION

1. Field of the Invention

This invention relates to a lift for smaller wheeled vehicles, and more particularly to the lifting of vehicles and providing optimum access to the workings of the vehicle so as to facilitate maintenance thereof. The vehicle lift disclosed herein is useful for providing greater access to small tractors, riding lawnmowers, riding snow blowers, all terrain vehicles, golf carts, and the like than previously available from ordinary lifts; for accommodating vehicles of a variety of wheel base sizes; for making repair and maintenance of vehicles easier and less expensive; for providing a space saving vehicle lift; and for providing repairmen with access to otherwise inaccessible places of a vehicle. In addition, the vehicle lift apparatus includes safety features for preventing the lifted vehicle from unwantedly lowering and may additionally be locked in place in any desired position.

2. Description of the Prior Art

Use of small vehicles including riding lawnmowers, small tractors, snow blowers and the like have become increasingly popular in reducing the work and energy output of the operator. With the vehicle's popularity has come an increasing need to provide maintenance for the care and upkeep of these vehicles. The small size of these vehicles requires a densely packed engine and drive means. When performing work on these densely packed vehicles it is necessary for the mechanic to have as much all-directional access as possible. To provide the mechanic with this access, it has been proposed that the vehicle be placed on a lift and raised into the air in similar fashion to a standard size automobile. However, several problems arise when applying a standard automobile size lift to a smaller vehicle, including addressing the different wheel base sizes of the smaller vehicles and providing an obstruction free area about the raised vehicle to allow the mechanic optimum access to the small vehicle engine.

U.S. Pat. No. 4,084,790 issuing to Molnar on Apr. 18, 1978 discloses a service lift for vehicles comprising two spaced lift arms connected to vertical shafts. The arms raise a pair of parallel adjustably spaced troughs. By maneuvering a turntable and spin combination, the two troughs can be brought closer together while still maintaining a parallel angle thereto. The turntable and spin combination include shafts extending downward. In addition, the troughs include permanently attached ramps connected to a first distal end of the troughs as well as no stop at the opposite distal end. The Molnar lift also includes several cross bars connecting the two troughs, as well as floor mounted base member connecting the two vertical shafts. The Molnar lift includes many components hanging downward and located within the space created by the lift below a raised vehicle thereby providing obstacles to and making the job of the repairman more difficult in accessing difficult to reach vehicle components.

U.S. Pat. No. 3,035,812 issuing to Wineteer on Dec. 22, 1959, discloses a vehicle towing dolly on which a vehicle is mounted and then towed. The dolly comprises cradles to accommodate the wheels of the vehicles. The cradles are mounted on a pair of wheels that provide the mobility for the dolly. In addition, the cradles may be lifted into the air by supporting posts so as to prevent drag of the cradles on the ground during towing. Finally, a ramp onto which the vehicle tire can be guided so as to fit within the cradle includes a ramp which can be placed in an upright position when the vehicle tire has been secured within the cradle. The Wineteer towing dolly is not intended to provide sufficient lift to enable one to position oneself below the vehicle in order to reach difficult and inaccessible locations within the vehicle and perform repairs and maintenance thereon.

U.S. Pat. No. 4,225,117 issuing to Suzuki on Sep. 30, 1980, discloses a vehicle lift safety feature that takes up any slack and alerts the operator of slack in a cable used to operate the lift. In addition to the safety feature, Suzuki discloses arms pivotally connected to lift brackets. The arms pivot angularly as well as extend in length to accommodate vehicles of different wheel bases. The Suzuki reference makes use of pads that directly engage the vehicle to be elevated by the lift. In addition, the Suzuki lift operates by a series of pulleys and endless cable running between the two lift brackets. The endless cable runs along the ground between the two lift brackets. The Suzuki reference, by engaging a portion of the elevated vehicle, limits access to the underside of the vehicle. In addition, the endless cable running below the elevated vehicle limits mobility within the space created below the elevated vehicle.

U.S. Pat. No. 5,009,287 issuing to Starr on Apr. 23, 1991, discloses a vehicle lift having supporting arms pivotally connected to a vertical lift. The supporting arms include a first element housing a second telescoping element. The second telescoping element includes padding for directly engaging the vehicle to be lifted. The two vertical lifts are connected by an overhead cross member housing wiring therein. By directly engaging the vehicle, the Starr lift limits access to the undercarriage of the vehicle lifted into the air.

U.S. Pat. No. 4,776,569 issuing to Nestel-Eichhausen on Oct. 11, 1988, discloses a vehicle hoist used for raising vehicles to be worked on. The vehicle hoist includes two stationary vertical columns having carrier arms adjustably and pivotally mounted thereto and a cross member running along the ground connecting the two columns. The cross member houses wiring. The carrier arms connect to the vertical columns through an adjustable mounting means that allow the arms to move in a vertical up/down direction as well as an angular direction (with respect to the point of connection between the arms and the mounting means). The mounting means in conjunction with the vertical columns provides support for the arms when a vehicle is mounted thereon. The arms comprise a first member housing a second telescoping member. The Second telescoping member directly engages the vehicle through plates mounted on a distal end thereof. Additional vehicular support is provided by connecting arm extending from a vertical column. The second connecting arm includes a first member and a second telescoping member. The second telescoping member directly engages the vehicle through a slotted plate which bolts onto a tire base. As with the references cited above, by directly engaging the vehicle to be lifted (herein from the sides and below) the lift limits the access the repairman is afforded to the vehicle.

U.S. Pat. No. 4,545,462 issuing to Sul on Oct. 8, 1985, discloses a lift for vehicles comprising outwardly projecting arms that engage the vehicle to be lifted. The lift includes hydraulic lifts which engage the arms with a series of cables and pulleys. The cables and pulleys serve balance the arms as the vehicle is lifted. In addition, the arms are attached to the lifts via a guide housing. The arms engage the guide housing in a pivot arrangement so as to provide lateral angular motion by the arms to engage vehicles of different wheel bases. The telescoping arms engage the vehicle through pads that directly contact and lift the vehicle, thereby limiting access to the vehicle's undercarriage. In addition, cables running along the ground limit the mobility of the workman in the space created below the raised vehicle.

U.S. Pat. No. 4,022,428 issuing to Mantha on May 10, 1977, discloses a lift for vehicles including a support frame having two vertical columns having lifting arms attached thereto. A motor and cable drive system work in conjunction with the lifting arms to raise the arms and a load thereon into the air. The lifting arms include a mounting arrangement with the vertical columns that allow the arms to swing in angular lateral directions. In addition, the arms include a second portion that telescopes from a first portion so as to accommodate narrower vehicles. As mentioned above, the telescoping arms directly engage the vehicle to be lifted, thereby limiting access thereto.

U.S. Pat. No. 3,958,664 issuing to Perkins on May 25, 1976, discloses a lift for vehicles including a fail safe mechanism for automatically engaging the lifting means of the lift. The lift includes a pair of vertical columns having telescoping arms affixed thereto. The arms are lifted and lowered via a drive means which has the fail safe mechanism attached thereto. This reference concerns safety measure in the even of lift failure rather than space conservation as may be required for the specific application to smaller vehicles.

U.S. Pat. No. 2,720,036 issuing to Berger on Oct. 11, 1955, discloses a combination lift and alignment machine for vehicles. The lift portion of the device includes a pair of parallel troughs centrally connected by a cross member. The cross member is also attached to the lifting portion of the machine. The lifting portion is situated below the pair of troughs. The troughs are held in a parallel position by the cross member. In addition, the troughs include rams attached to a distal end of the troughs. The ramps are held on the troughs with hinges so as to facilitate movement of the ramps with respect to the troughs. The opposite distal ends of the troughs include wheel aligning mechanism which takes up valuable space and may be redundant for smaller vehicles that do not usually require wheel alignments.

U.S. Pat. No. 1,869,283 issuing to Stukenborg on Jun. 9, 1930, discloses a lift for vehicles including two troughs attached to each other and a lifting frame by a pair of cross members. The troughs are held parallel to each other to accommodate the wheels of a vehicle to be raised by the lift. The troughs further include ramps attached to the troughs by a pin arrangement so as to allow movement of the ramps with respect to the troughs. The forward portion of the lift includes means for directly engaging the vehicle thereby providing the same limitations as mentioned above.

SUMMARY OF THE INVENTION

The present invention comprises a small vehicle lift having two vertical columns securely mounted to the ground or the floor of a building. A first vertical column includes a motor for operating a set of pulleys and cables housed within the first vertical column. The a second motor may be housed within the second vertical column. Alternately, one motor may control the operation of both the first and second vertical columns.

The pulleys and cables manipulate a first and second mounting bracket housed within interior tracks of the first and second vertical columns. The mounting brackets are manipulated in a vertical direction within the interior tracks of the each of the first and second vertical columns. Mounted on the mounting brackets are linear arms which are rotatable in an axis about the mounting bracket to provide lateral adjustment between each pair of linear arms.

The linear arms each have a telescoping member therein. The configuration of the first and second members are such as to accommodate the weight of a wheeled vehicle. On a distal end of the telescoping members, opposite from the mounting bracket, is mounted a trough.

The trough is pivotally connected near each end to the telescoping members. The trough and is of sufficient width to accommodate the tire width of a wheeled vehicle. The trough includes raised side borders. In addition, the trough includes a stop positioned at one distal end of the trough. On the opposite distal end is mounted a removable ramp held to the trough by a locking pin system.

The above mentioned and other features and objects of the invention, and the manner of attaining them will be best understood by reference to the following description of an embodiment of the invention, when considered in conjunction with the accompanying drawings:

DESCRIPTION OF THE PREFERRED EMBODIMENT

Figure 1:
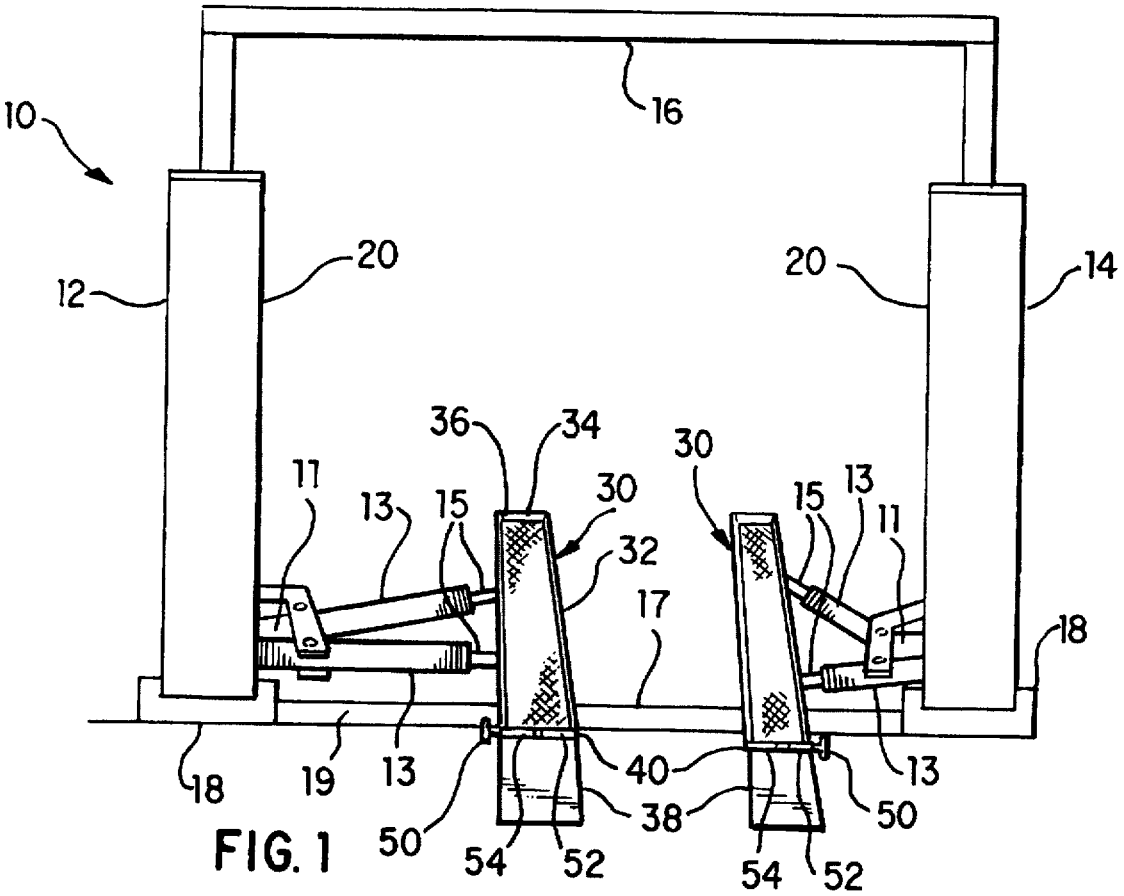
FIG. 1 is a perspective view of the vehicle lift showing vertical columns with both a floor mounted connection and an overhead connection, mounting brackets, lateral arms, and two troughs.
Figure 2:
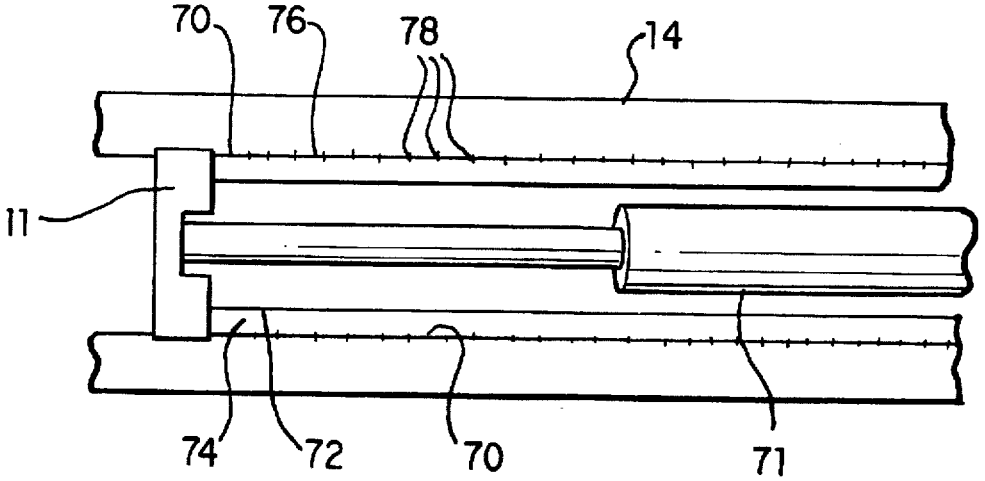
FIG. 2 is a side view of a vertical column showing the interior track thereof.
Figure 3:
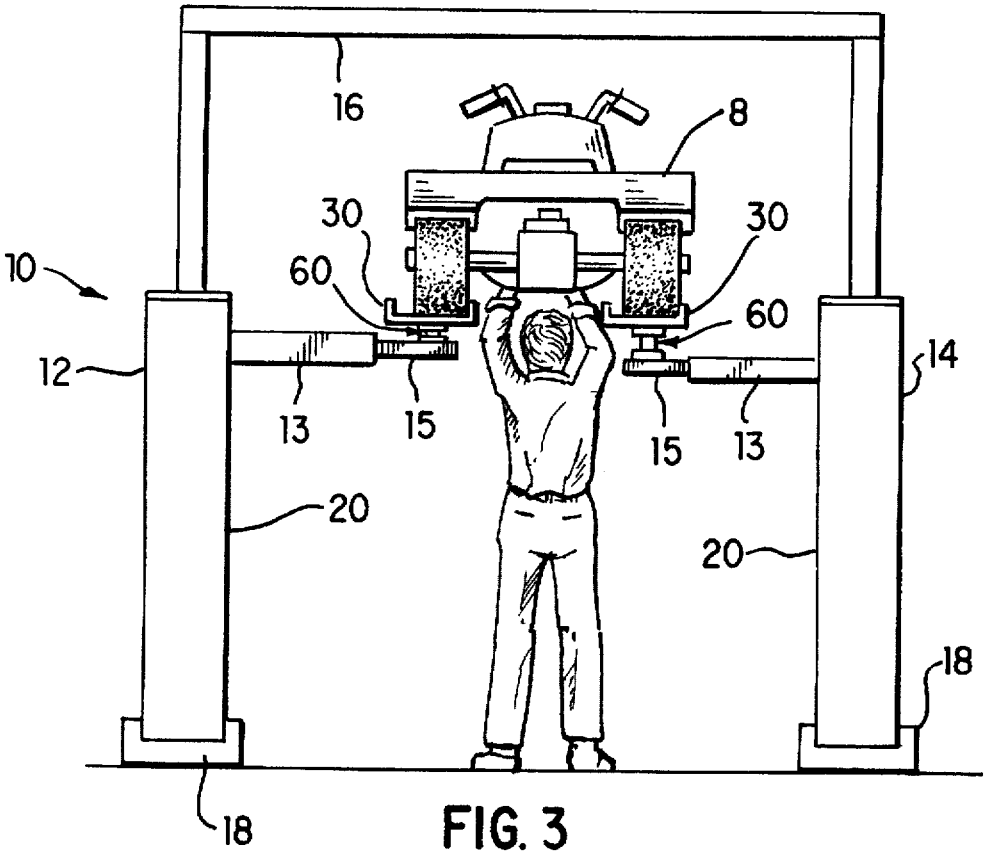
FIG. 3 is a front view of the vehicle lift having a vertical connection, and showing a raised wheeled vehicle raised above a person for ease of access beneath the motor.

The vehicle lift apparatus 10 disclosed herein, and shown in FIG. 1–11, comprises a first vertical column 12 and a second vertical column 14. The first and second vertical columns are preferably connected by an overhead cross bar 16, as shown in FIG. 3. The overhead cross bar 16 provides stability and electrical and/or hydraulic communication between the first and second vertical columns 12, 14.

Figure 6:
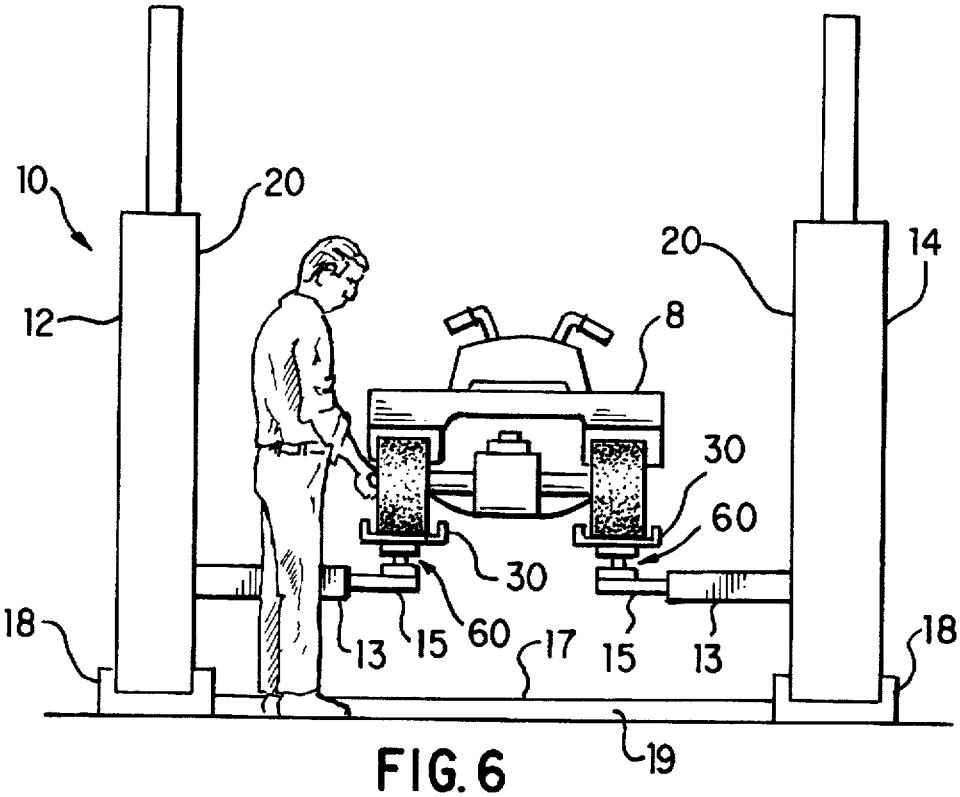
FIG. 6 is a front view of the vehicle lift having a floor connection, showing a raised wheeled vehicle on extended lateral arms, mounting brackets and vertical columns.

Alternately, a floor mounted cross bar 17 attaches the bases of the vertical columns and provides a path for electrical and/or hydraulic communication between the first and second vertical columns 12, 14, as shown in FIG. 6. A combination of overhead and floor mounted cross bars 16, 17 may also be used, as shown in FIG. 1.

The floor mounted cross bar 17 preferably has a gently sloping incline 19 from the floor to the height of the floor mounted cross bar 17, thereby providing as little obstacle as possible to repairmen working below raised troughs 30. In addition, the floor mounted cross bar 17 is made of a material sufficiently strong material to withstand the weight of workmen and vehicles, as known in the art.

The first and second vertical columns are mounted to the floor by any suitable conventional mounting means 18. Mounting means 18 may comprise any mounting means known in the art for providing stability for vehicle lifts, such as anchor bolts, etc.

As best shown in FIG. 2, the first and second vertical columns 12, 14 each include an opening 20 running the interior length of the vertical columns. Within opening 20 runs a track 70 (FIG. 2) on which mounting means 11 are slidably received.

As depicted in FIG. 2, mounting means 11 are connected with cables 72 that run the length of the vertical columns. In the preferred embodiment, the cables 72, in conjunction with a hydraulic piston 71, and hydraulic motor with suitable controls (not shown), selectively lift and lower the mounting means 11 along the track. Alternately, other motor means, such as an electrical motor (not shown) may be used to selectively raise and lower the mounting means 11. The motor means and associated controls may be remotely located from the first and second vertical columns 12, 14.

Along an interior wall 74 of track 70 run a series of mount stops 76. Stops 76 comprise a plurality of vertical and co-linear rectangular portions (not shown) recessed into the vertical columns 12, 14. The rectangular portions are interspaced by outwardly protruding rectangular portions 78 that serve to catch the mounting means 11 in the event that the mounting means 11 descends uncontrollably.

The first and second lifting means 12, 14 are interconnected to simultaniously raise and lower the troughs 30 in parallel alignment, between raised and lowered positions shown in FIG. 1 and FIG. 3. The first and second lifting means 12, 14 may be raised in unison to any suitable height for ease of working upon a vehicle positioned upon the troughs 30. See FIG. 6.

It is an important feature of this invention, that the first and second lifting means 12, 14 are raised and lowered in unison, so that a vehicle is not unbalanced upon the troughs 30.

Pivotally mounted on the distal ends of mounting means 11 are are a pair of horizontally disposed pivotal linear arms 13. Each of the horizontally disposed linear arms 13, has a horizontally extendable telescoping arm portion 15, which are housed within and telescope from each horizontally disposed pivotal linear arm 13.

A pivotal connection means 60 is disposed upon the distal end of each of the pair of horizontally extendable telescoping arm portions 15. One of the pivotal connection means 60 is pivotally secured near one end of a horizontally disposed trough 30. The other pivotal connection means 60 is pivotally secured near the other end of the trough 30.

Figure 5:
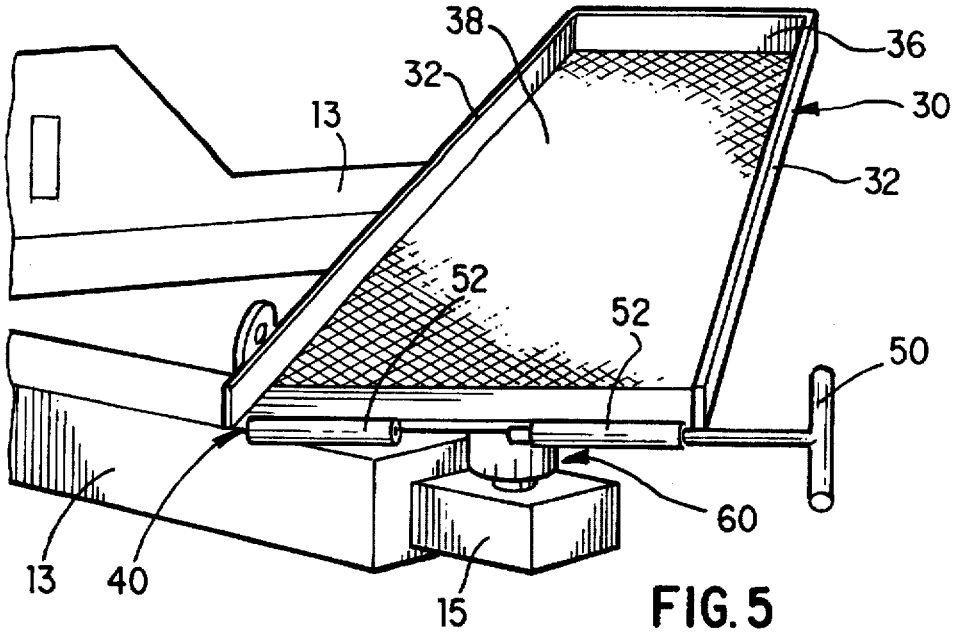
FIG. 5 is a perspective view of a trough, without a ramp, showing raised borders, raised stop and pin locking arrangement.

Troughs 30 are of sufficient width so as to accommodate the width of a tire of a wheeled vehicle thereon. The trough is made of any suitable material known in the art to withstand the weight of a wheeled vehicle as well as the abuse associated with a vehicle being driven thereon. Preferably, the first and second troughs 30 are each substantially made of expanded metal plate material 38. The side lengths of troughs 30 are defined by raised walls 32, and a back stop 34 is positioned on one distal end 36 of the trough. Located at the opposite distal end of the trough 30 is a removable ramp 38 affixed by a locking pin arrangement 40. The troughs 30 are depicted in FIG. 3, FIG. 5 and FIG. 6 with the ramps 38 removed. The troughs 30 are depicted in FIG. 1 and FIG. 4 with the ramps 38 installed upon the troughs 30.

As shown in FIG. 3, troughs 30 are rotatably mounted on pivots 60. Pivots 60 allow angular rotation of troughs 30 with respect to second elongated arm 15, when the elongated arm 15 is telescoped outward from first elongated arm 13. Pivots 60 allow troughs 30 to remain relatively parallel to each other while the elongated arms 15 are extended or retracted, thereby selectively bringing the troughs 30 closer together or farther apart. As a result, the lift vehicle apparatus 10 can be made to accommodate wheeled vehicles 8 of different wheel base sizes.

Figure 4:
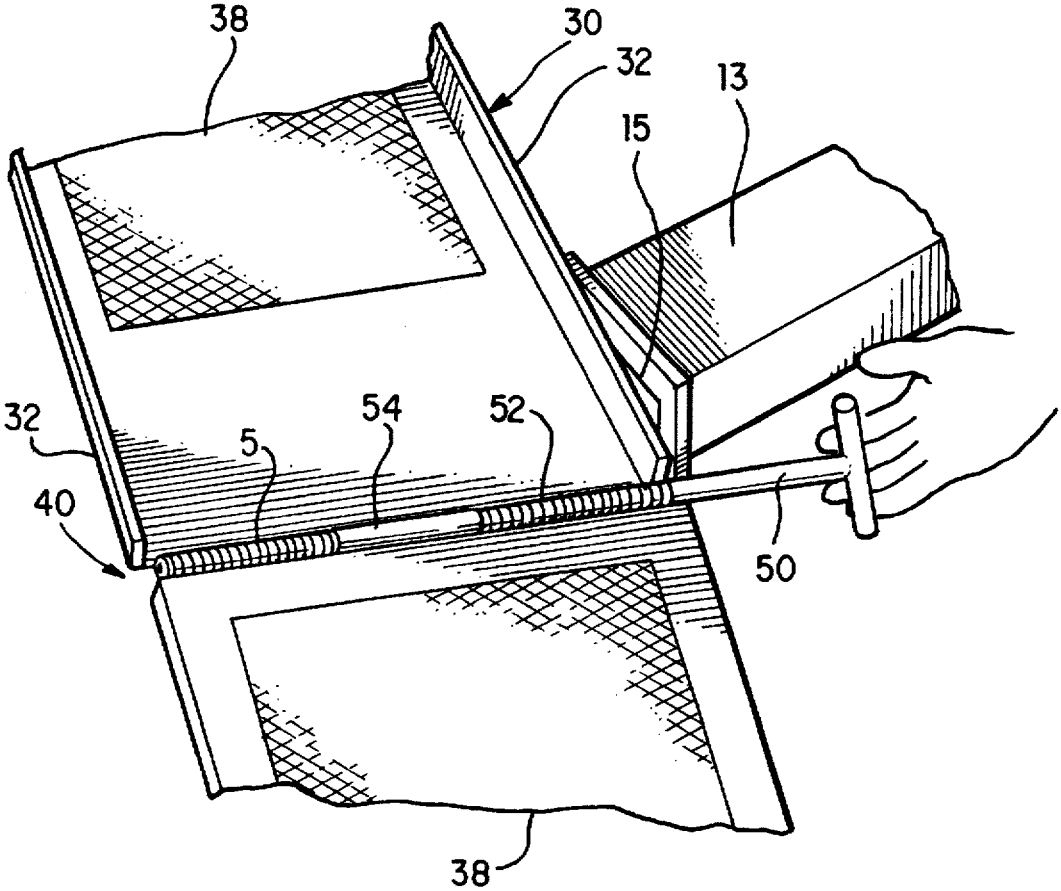
FIG. 4 is a perspective view of the pin locking arrangement, showing a pin inserted in offset apertures.

The locking pin arrangement is depicted in FIG. 4, wherein pin 50 is securely and slidably received within at least one aperture 52 secured to the trough 30. At least one aperture 54 is secured to one end of the ramp 38. The apertures 52, 54 are spaced in alternating alignment, to slidably receive a pin 50 therein. Pin 50 may me inserted or removed from apertures 52, 54 by hand. The pin 50 preferably has a T-handle for ease of grasping the pin 50. Preferably, pin 50 may be inserted from either side of the trough 30, to suit user preference.

It is within the scope of this disclosure to utilize two or more apertures 52 secured to the trough 30, and two or more apertures secured to ramp 38, in alternating spaced alignment, to pivotally and removably secure a ramp 38 to each trough 30, using pin 50. FIG. 1 shows two apertures 52, 54 being used, whereas FIG.4 and FIG. 5 show three apertures 52, 54 being used.

Additional apertures 52, 54 may be used to suit manufacturing and design preference. The apertures are preferably alternately secured to adjacent ends of each trough 30 and ramp 38, to provide a hinged connection therebetween. Pin 30 is sized to be slidably received within the apertures 52, 54 to removably secure a ramp 38 to a trough 30.

When the pin 50 is slid into the pin arrangement 40, the pin arrangement acts as a hinge pivotally connecting the ramp 38 to the trough 30. By this arrangement, a wheeled vehicle 8 can be rolled over the ramp 38, onto the troughs 30, the ramps 38 may then be removed by removing the pin 40 from the apertures 52, 54 and the vehicle subsequently raised by raising the troughs 30.

For safety, the vehicle 8 tires may be secured to the trough 30 prior to lifting, or a suitable stop (not shown) may be provided to keep the vehicle 8 from rolling off the troughs 30.

The ramp 38 is removed from each trough 30, to provide additional room for a mechanic to maneuver about the vehicle 8 located on the vehicle lift apparatus 10, as best shown in FIG. 5 and FIG. 6. By this arrangement, a workman is provided with additional access to the wheeled vehicle 8 without having to work around the ramp 38.

Thus, while the novel vehicle lift apparatus 10 has been fully disclosed and described herein, numerous modifications will become readily apparent to one of ordinary skill in this art, and such adaptations and modifications will become readily apparent to one of ordinary skill in this art, and such adaptions and modifications are intended to be include within the scope of the claims.

What is claimed is:

1. A vehicle lift apparatus, comprising:

a) a first lifting means having a vertical column from which a pair of horizontally disposed pivotal linear arms are vertically adjustable therefrom, each of the horizontally disposed pivotal linear arms has a horizontally extendable telescoping arm portion, with a pivotal connection means horizontally disposed upon the distal end of each of the horizontally extendable telescoping arm portions;

b) a second lifting means disposed in opposing, spaced relation from the first lifting means, the second lifting means having a vertical column from which a pair of horizontally disposed pivotal arms are vertically adjustable therefrom, each of the horizontally disposed pivotal arms has a horizontally extendable telescoping arm portion, with a pivotal connection means disposed upon the distal end of each of the horizontally extendable telescoping arm portions;

c) a first horizontally disposed trough secured near one end to the pivotal connection means disposed upon the distal end of one of the pair of horizontally extendable telescoping arm portions on the first lifting means, and the other end of the first horizontally disposed trough secured to the pivotal connection means disposed upon the distal end of another of the pair of horizontally extendable telescoping arm portions on the first lifting means; the first horizontally disposed trough having raised sides spaced to accommodate the width of a vehicle tire, a length sized to receive a vehicle thereon, with a raised stop positioned at one end of the through, and a removable ramp pivotally and releasably secured to the opposite end of the trough with a removable locking pin;

d) a second horizontally disposed trough secured near one end to the pivotal connection means disposed upon the distal end of one of the pair of horizontally extendable telescoping arm portions on the second lifting means; and the other end of the second horizontally disposed trough secured near the other end to the pivotal connection means disposed upon the distal end of another of the pair of horizontally extendable telescoping arm portions on the second lifting means, the second horizontally disposed trough having raised sides spaced to accommodate the width of a vehicle tire, a length sized to receive a vehicle thereon, with a raised stop positioned at one end of the trough, and a removable ramp releasably and pivotally secured to the opposite end of the trough with a removable locking pin; the spacing between the first horizontally disposed trough and the second horizontally disposed trough being adjustable in width to accommodate vehicles having different tire spacing and tread width; and e) an operatively connected power means and controls for vertically, simultaniously raising and lowering the first lifting means in relation to the second lifting means.

2. The vehicle lift apparatus of claim 1, wherein the operatively connected power means for vertically, simultaneously raising and lowering the first lifting means in relation to the second lifting means is at least one hydraulic pump having a suitable piston, reservoir, controls, and associated tubing.

3. The vehicle lift apparatus of claim 1, wherein the operatively connected power means for vertically, simultaneously raising and lowering the first lifting means in relation to the second lifting means comprises at least one electric motor, controls, and associated wiring.

4. The vehicle lift apparatus of claim 1, wherein the first and second trough are each substantially made of expanded metal plate material.

5. The vehicle lift apparatus of claim 1, wherein the first and second releasably secured ramps are each substantially made of expanded metal plate material.

6. The vehicle lift apparatus of claim 1, wherein an overhead cross bar interconnects the first lifting means in relation to the second lifting means, the overhead cross bar further provides access for a power connection means to extend between the first lifting means and the second lifting means.

7. The vehicle lift apparatus of claim 1, wherein a floor mounted cross bar interconnects the first lifting means in relation to the second lifting means and provides access for a power connection means to extend between the first lifting means and the second lifting means.

8. The vehicle lift apparatus of claim 7, wherein an inclined ramp extends from the floor to a height substantially equal to the height of the floor mounted cross bar, to reduce the likelihood of tripping on the floor mounted cross bar during use.

9. The vehicle lift apparatus of claim 1, wherein the pin used to releasably secure the removable ramp to the trough is a T-handle pin sized to be slidably received through alternating apertures disposed in alignment on adjacent ends of the trough and the ramp.

10. A vehicle lift apparatus, comprising:

a) a first lifting means having a vertical column from which a pair of horizontally disposed pivotal linear arms are vertically adjustable therefrom, each of the pair of horizontally disposed pivotal linear arms has a horizontally extendable telescoping arm portion, with a pivotal connection means horizontally disposed upon the distal end of each of the horizontally extendable telescoping arm portions;

b) a second lifting means disposed in opposing, spaced relation from the first lifting means, the second lifting means having a vertical column from which a pair of horizontally disposed pivotal arms are vertically adjustable therefrom, each of the pair of horizontally disposed pivotal arms has a horizontally extendable telescoping arm portion, with a pivotal connection means disposed upon the distal end of each of the horizontally extendable, telescoping arm portions;

c) a first horizontally disposed trough secured near one end to the pivotal connection means disposed upon the distal end of one of the pair of horizontally extendable telescoping arm portions on the first lifting means; and the first horizontally disposed trough secured near the other end to the pivotal connection means disposed upon the distal end of the other of the pair of horizontally extendable, telescoping arm portions on the first lifting means; the first horizontally disposed trough having raised sides spaced to accommodate the width of a vehicle tire, a length sized to receive a vehicle thereon, with a raised stop positioned at one end of the through, and a removable ramp releasably secured to the opposite end of the trough with a pivot pin; the first horizontally disposed trough being substantially made of expanded metal plate material;

d) a second horizontally disposed trough secured near one end to the pivotal connection means disposed upon the distal end of one of the pair of horizontally extendable telescoping arm portions on the second lifting means; and the second horizontally disposed trough secured near the other end to the pivotal connection means disposed upon the distal end of another of the pair of horizontally extendable telescoping arm portions on the second lifting means, the second horizontally disposed trough having raised sides spaced to accommodate the width of a vehicle tire, a length sized to receive a vehicle thereon, with a raised stop positioned at one end of the trough, and a removable ramp releasably secured to the opposite end of the trough with a pivot pin; the second horizontally disposed trough being substantially made of expanded metal plating; the spacing between the first horizontally disposed trough and the second horizontally disposed trough being adjustable to accommodate vehicles having different tire spacing and tread width; and e) an operatively connected hydraulic power means with associated hydraulic reservoir, and controls for selectively, simultaneously raising and lowering the first lifting means in relation to the second lifting means.

11. The vehicle lift apparatus of claim 10, wherein the locking pin used to releasably secure the removable ramp to the trough is a T-handle pin sized to extend through at least one aperture in the trough, and at least one aligned aperture in the ramp.

12. The vehicle lift apparatus of claim 10, wherein an overhead cross bar interconnects the first lifting means to the second lifting means, and provides access for a power connection means between the first lifting means and the second lifting means.

13. The vehicle lift apparatus of claim 10, wherein a floor mounted cross bar interconnects the first lifting means to the second lifting means to provide access for a power connection means there between.

14. The vehicle lift apparatus of claim 13, wherein an inclined portion extends from the floor to a height substantially equal to the height of the cross bar, to reduce the likelihood of tripping over the cross bar during use.

15. The vehicle lift apparatus of claim 10, wherein the first and second releasably secured ramps are each substantially made of expanded metal plate material.

16. A vehicle lift apparatus, comprising:

a) a first lifting means having a vertical column from which a pair of horizontally disposed pivotal linear arms are vertically adjustable therefrom, each of the pair of horizontally disposed pivotal linear arms has a horizontally extendable telescoping arm portion, with a pivotal connection means horizontally disposed upon the distal end of each of the horizontally extendable telescoping arm portions;

b) a second lifting means disposed in opposing, spaced relation from the first lifting means, the second lifting means having a vertical column from which a pair of horizontally disposed pivotal arms are vertically adjustable therefrom, each of the pair of horizontally disposed pivotal arms has a horizontally extendable telescoping arm portion, with a pivotal connection means disposed upon the distal end of each of the horizontally extendable telescoping arm portions;

c) a first horizontally disposed trough secured near one end to the pivotal connection means disposed upon the distal end of one of the pair of horizontally extendable telescoping arm portions on the first lifting means; and the first horizontally disposed trough secured near the other end to the pivotal connection means disposed upon the distal end of the other of the pair of horizontally extendable telescoping arm portions on the first lifting means; the first horizontally disposed trough having raised sides spaced to accommodate the width of a vehicle tire, a length sized to receive a vehicle thereon, with a raised stop positioned at one end of the through, and a removable ramp releasably secured to the opposite end of the trough with a T-handle pin sized to extend through at least one aperture in the trough and at least one aligned aperture in the ramp;

d) a second horizontally disposed trough secured near one end to the pivotal connection means disposed upon the distal end of one of the pair of the horizontally extendable telescoping arm portions on the second lifting means; and the other end of the second horizontally disposed trough secured near the other end to the pivotal connection means disposed upon the distal end of another of the pair of horizontally extendable telescoping arm portions on the second lifting means, the second horizontally disposed trough having raised sides spaced to accommodate the width of a vehicle tire, a length sized to receive a vehicle thereon, with a raised stop positioned at one end of the trough, and a removable ramp releasably secured to the opposite end of the trough with a T-handle pin sized to extend through at least one aperture in the trough, and at least one aligned aperture in the ramp; the spacing between the first horizontally disposed trough and the second horizontally disposed trough being adjustable to accommodate vehicles having different tire spacing and tread width; and e) an operatively connected electrical power means and controls, for vertically, simultaneously raising and lowering the first lifting means in relation to the second lifting means.

17. The vehicle lift apparatus of claim 16, wherein the first and second troughs are each substantially made of expanded metal plate material.

18. The vehicle lift apparatus of claim 1, wherein the first and second releasably secured ramps are each substantially made of expanded metal plate material.

19. The vehicle lift apparatus of claim 16, wherein an overhead cross bar interconnects the first lifting means to the second lifting means, providing access for a power connection between the first lifting means and the second lifting means.

20. The vehicle lift apparatus of claim 16, wherein a floor mounted cross bar interconnects the first lifting means to the second lifting means, providing access for a power connection therebetween.

* * * * *